US005165499A

United States Patent [19]

Bell

[11] Patent Number: 5,165,499

[45] Date of Patent: Nov. 24, 1992

[54] ANCHOR SYSTEM FOR USE WITH FALL PREVENTION SAFETY DEVICES

[76] Inventor: Michael Bell, 1705 Triumphe Way, Warrington, Pa. 19876

[21] Appl. No.: 761,121

[22] Filed: Sep. 17, 1991

[51] Int. Cl.[5] ..... A62B 35/00

[52] U.S. Cl. ..... 182/9

[58] Field of Search ..... 182/3-9

[56] References Cited

U.S. PATENT DOCUMENTS

| | | | |
|---|---|---|---|
| 2,303,954 | 12/1942 | Roke | 182/3 |
| 2,459,545 | 1/1949 | Schultz | 182/3 |
| 2,833,343 | 5/1958 | Benson | 182/3 |
| 3,410,364 | 11/1968 | Fountain | 182/9 |
| 4,407,392 | 10/1983 | Lazzari | 182/3 |
| 4,951,778 | 8/1990 | Halvorson | 182/8 |

*Primary Examiner*—Reinaldo P. Machado
*Attorney, Agent, or Firm*—Caesar, Rivise, Bernstein, Cohen & Pokotilow, Ltd.

[57] ABSTRACT

An anchor system for use with a lanyard secured to a worker located at an elevated position to prevent the worker from falling. The anchor system is arranged to be releasably secured to a fixed member, e.g., an I-beam, adjacent the elevated position and comprises a releasable holding assembly and an associated connector assembly. The holding assembly comprises an elongated flexible strap and a releasable fastening/locking device. The releasable fastening/locking device is a ratchet-operated member fixedly secured to one end portion of the strap for receiving the other end portion of the strap so that the strap can be tightly encircled about a portion of the fixed member against accidental slippage or disconnection. The connector assembly comprises a sleeve having a ring fixedly mounted thereon. The sleeve is arranged to receive the strap therethrough to mount it on the strap at any desired position. The lanyard is connected to the anchor assembly via the ring.

5 Claims, 2 Drawing Sheets

ANCHOR SYSTEM FOR USE WITH FALL PREVENTION SAFETY DEVICES

BACKGROUND OF THE INVENTION

This invention relates generally to safety apparatus and more particularly to a system for releasable securement to some portion of a building to serve as an anchor for a personnel safety device to be releasably connected thereto.

Due to the enactment of various safety laws, persons working at elevated positions, e.g., on steel construction beams of a building as it is erected, etc., are required to be protected against falls. One common approach to achieve that end is the use of a safety belt which is worn on the worker's waist. The belt includes a D-ring or some other metal loop fixedly mounted on the belt in the center of the portion located at the worker's back. The D-ring is arranged to be "tied off" (connected), via a lanyard, to a fixed supporting member or anchor point. The anchor point may be any fixed portion, e.g. an I-beam, of the building which is strong enough to support the worker's weight. The securement of the lanyard to the anchor point is typically accomplished by wrapping the lanyard at least once about the anchor point, e.g., I-beam. Thus, once the worker is tied off should he/she fall off of the structure he/she will be prevented from falling to the ground.

While this technique of preventing falls is generally suitable for its intended purposes it never the less suffers from some drawbacks. For example, by wrapping the lanyard at least once about the anchor point the already relatively short standard lanyard (e.g., typically six feet in length) is substantially reduced, thereby severely restricting the worker's mobility. If the lanyard is wrapped about a vertical member and is not held at the point at which it is wrapped about the member, it will likely slide down the member to the lowest point that it can. In so doing the worker may be exposed to a drop in excess of six feet, thereby violating OSHA regulations, before the lanyard becomes taut to preclude further droppage. Moreover, and most importantly, if the lanyard is wrapped about an anchor point which has sharp edges, such as an I-beam, its strength can be effectively reduced by as much as seventy percent due to friction.

The prior art has not addressed the foregoing factors in an adequate manner heretofore.

OBJECTS OF THE INVENTION

Accordingly, it is a general object of this invention to provide an anchor system which overcomes the disadvantages of the prior art.

It is a further object of this invention to provide an anchor system which can be readily and tightly wrapped about a structural member to form a solid and safe anchor point for a person.

It is still a further object of this invention to provide an anchor system which is simple in construction, yet is very rugged and once connected to a fixed structural member is resistent to sliding and abrasion.

SUMMARY OF THE INVENTION

These and other objects of this invention are achieved by providing an anchor system for use with a device, e.g., a lanyard, coupled to a worker at an elevated position to prevent the worker from falling. The anchor system is arranged to be releasably secured to a fixed member, e.g., an I-beam, located adjacent the elevated position and comprises releasable holding means and connection means.

The releasable holding means comprises an elongated strap and releasable fastening means. The strap is formed of a strong, yet flexible material having first and second end portions. The releasable fastening means is fixedly secured to the first end portion of the strap and comprises receiving means and releasable locking means. The receiving means is arranged for receiving the second end portion of the strap so that the strap encircles the fixed member. The releasable locking means is arranged to enable the encircling strap to be pulled tightly around the fixed member into good frictional engagement therewith to hold the strap in the position against accidental release. The connection means is arranged for mounting on the encircling portion of the strap at any desired position thereon and has a connector arranged to be releasably connected to the lanyard means.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
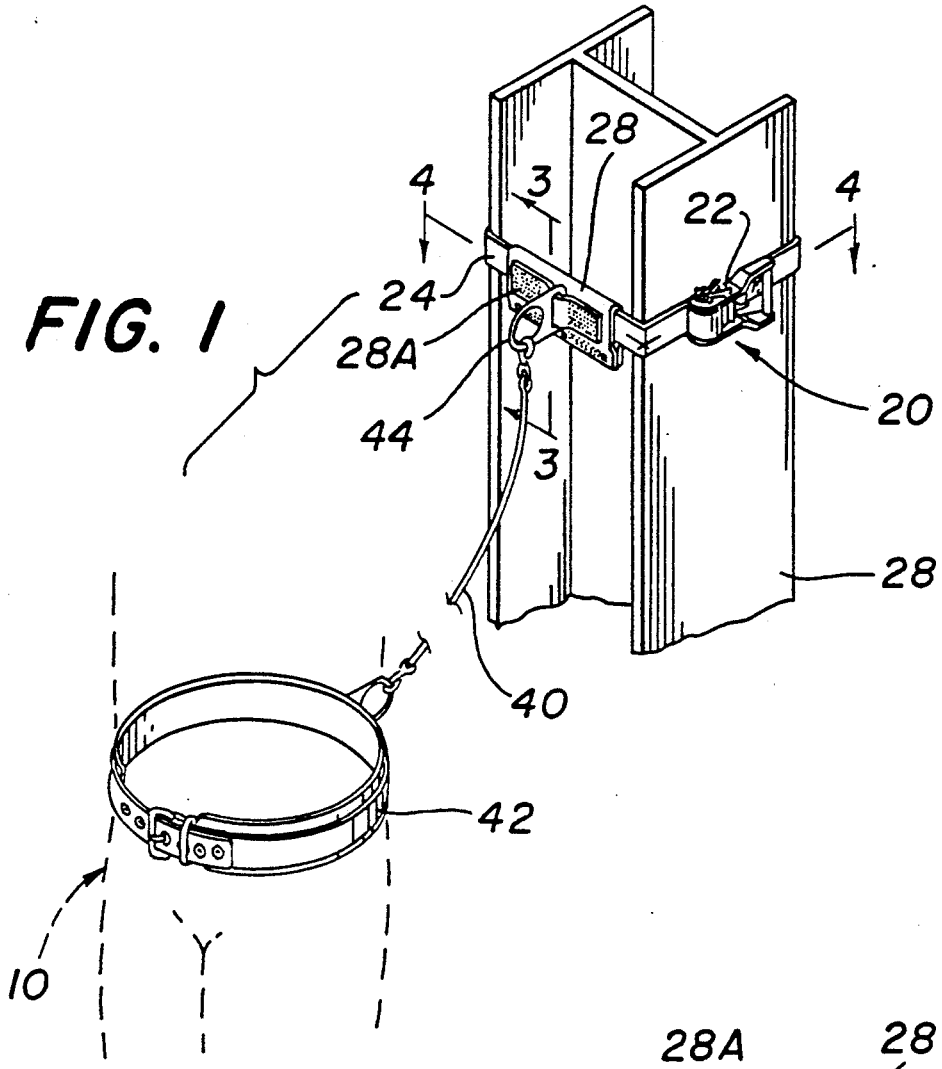
FIG. 1 is an isometric view of an anchoring system constructed in accordance with this invention shown in its operative condition, i.e., secured about an I-beam and connected via a lanyard to a waist belt worn by a worker.

Referring now to the various figures of the drawing wherein like reference characters refer to like parts, there is shown at 20 in FIG. 1, an anchoring system constructed in accordance with this invention. The system 20 is arranged, when connected to some fixed structure, to protect the worker 10 (shown in phantom lines in FIG. 1) from falling. To that end, the system 20 is arranged to be secured about a portion of a building or some other fixed structure, such as an I-beam. The system 20 need not connected to the I-beam as shown but may be connected to any fixed structural member which includes a portion that can be encircled and is of sufficient strength to safely support the worker from falling.

Figure 2:
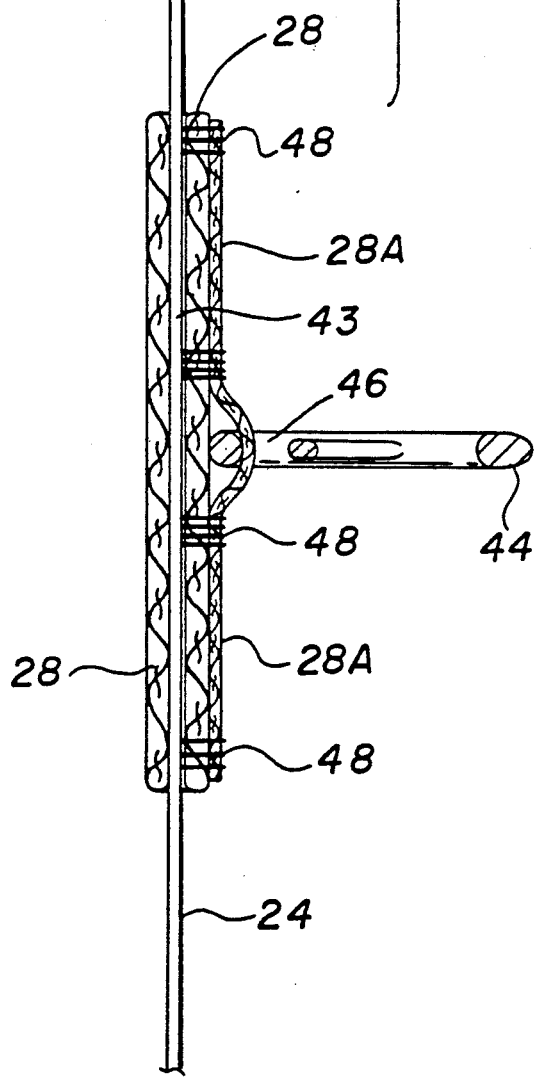
FIG. 2 is an enlarged, isometric view of the anchoring system shown in FIG. 1 prior to its use.
Figure 2:
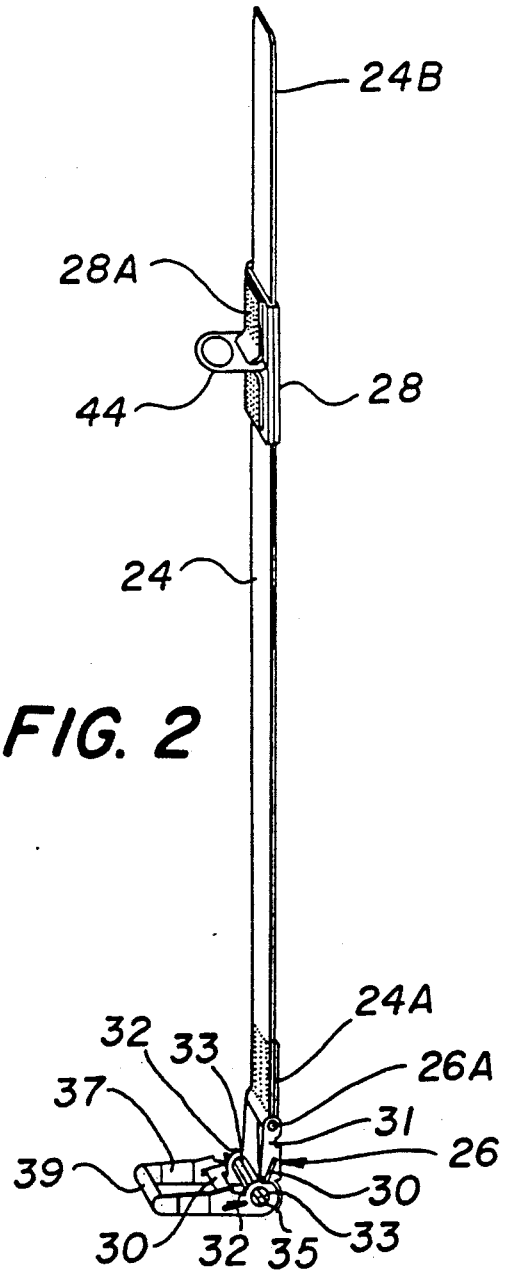

As can be seen clearly in FIG. 2, the system 20 basically comprises a ratchet assembly 22, a flexible strap 24, and an associated sleeve assembly 28. The strap is arranged to encircle the I-beam 28 with the ratchet assembly locking it tightly in place thereon. The sleeve assembly serves as the means for connecting the anchoring assembly to the lanyard and associated safety belt worn by the worker. In addition, depending upon its positioning about the fixed structure 28, the sleeve may serve to prevent the abrasion of the strap.

The strap 24 is formed of a woven, high strength material, e.g., nylon or polyester, webbing. In one preferred embodiment of this invention, the strap is approximately 2 inches (5.1 cm) wide and approximately 65 inches (165.8 cm) long. Other lengths of between 4 and 10 feet are equally effective, as may be almost any other length, depending upon the circumstances of use.

The ratchet assembly 26 is secured to on end 24A of the strap 24. This is accomplished by folding the strap end over itself about a pin 26A of a base portion 31 (to be described later) of the ratchet assembly 26, and sewing the folded portion and contiguous portion of the strap end 24 together.

The ratchet assembly 26 is arranged to releasably receive the opposite or free end 24B of the strap so that the strap can be formed into a loop to encircle the fixed structural member, e.g., the I-beam 28 as shown in FIG. 1, and then tightly drawn thereabout. Thus, the ratchet assembly is of any suitable conventional construction, such as the assembly sold by Weisner Steel, 77 Moraga Way, Orinda, Calif. 94563. In the preferred embodiment shown herein, the ratchet assembly includes a first spring-bias pawl mechanism 30 slidably mounted on a base member 31 of the assembly to engage the teeth of a pair of ratchet wheels 32 mounted on opposed ends of a reel 33. The reel includes a slot 35 into which the free end 24B of the strap is inserted. The ends of the reel extend through a pair of aligned holes in the base member and in a handle member 37 of the ratchet assembly. The handle member 37 also includes a second spring-bias pawl mechanism 30 to engage the teeth 32 on the ratchet wheels. The handle member 37 includes a handgrip portion 39 to be grasped by the user.

Figure 4:
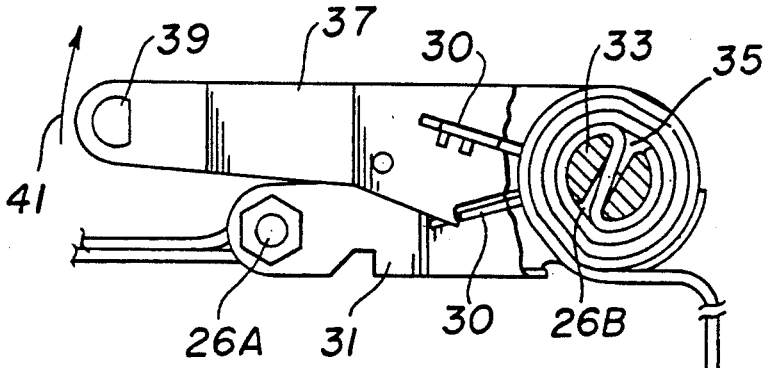
FIG. 4 is an enlarged, sectional view taken along lines 4—4 of FIG. 1.

When the free end portion 24B of the strap 24 is inserted into the slot 35 in the reel 33 and the handle member 37 pivoted in the direction of arrow 41 in FIG. 4 with respect to base portion 31, the strap will be reeled up on the reel so that the extending loop of the strap is tightened about the I-beam and resistant to accidental release or slippage. The engagement of the two pawl mechanisms 30 and the teeth 32 of the ratchet wheels lock the strap in place. The release of the engagement of the pawls mechanism and ratchet wheels is accomplished manually by pulling the pawls back out of engagement with the ratchet wheels.

Figure 3:
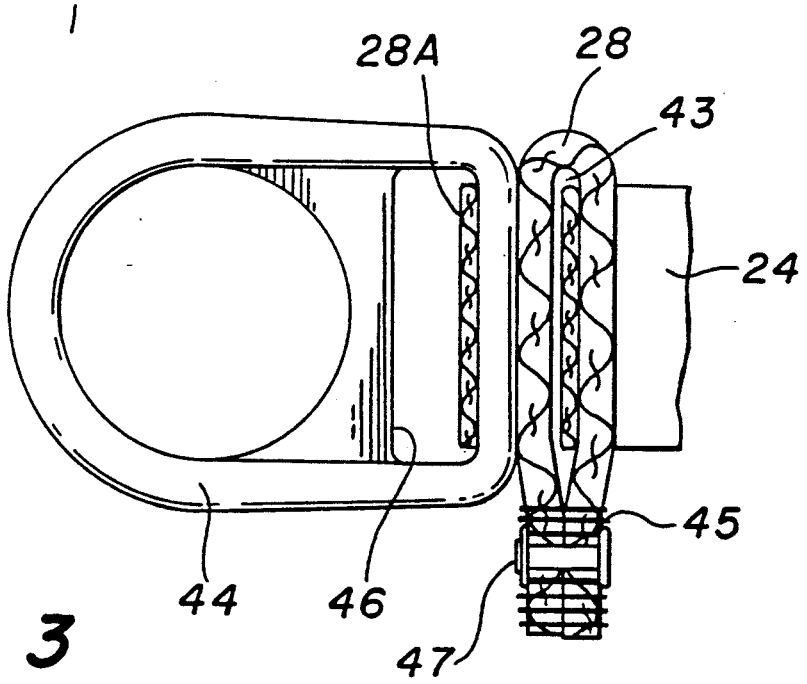
FIG 3 is an enlarged sectional view taken along lines 3—3 of FIG. 1.

As shown more clearly in FIGS. 1, 3 and 4, the sleeve 28 comprises a tubular member formed of the same webbing material forming the strap. The sleeve webbing is thus folded over itself to form a central passageway 43 extending therethrough. The strap 24 extends through the central passageway. The webbing forming the sleeve is sewn together at its bottom edge by a line of stitches 45 and is further held together by a plurality of rivets 47.

In order to provide means for connecting the lanyard 40 and the associated harness or belt 42 worn by the worker 10 to the anchor system 20, a conventional D-ring 44 is fixedly mounted on the sleeve 28 at the center of the sleeve. The D-ring being of conventional construction includes a transversely extending slot 46. This slot serves as a means to secure the D-ring to the sleeve 28. In particular, as can be seen in FIGS. 2 and 4, a short strip 28A of the same material forming the belt extends through the slot 46 of the D-ring and is fixedly secured on either side thereof by stitching 48 to the outer surface of the web making up the sleeve 28. Accordingly, the D-ring is fixedly secured to the sleeve but is free to pivot about an axis parallel to the slot to facilitate the connection of the lanyard to it.

When a worker wishes to utilize the anchor system 20 of the subject invention, the strap 24 is placed about the I-beam or other anchoring point and threaded into the slot 35 in the reel 33 of the ratchet mechanism. The handle portion is then repeatedly pivoted with respect to the base portion to draw the strap up on the reel, thereby tightening the loop of the strap about the I-beam until the anchor system is frictionally secured to the I-beam to prevent slippage. Once so secured, the worker 10 may then connect the lanyard 40 which is attached to the waist belt or harness worn by the worker to the D-ring 44 of the anchoring system. In the event the worker should fall from the platform or other support structure, the waist belt, lanyard and anchor system prevents the worker from falling further than the length of the lanyard, thereby minimizing and/or preventing injury and/or death. To release the ratchet and allow the strap to be disengaged, the pawls are pulled back manually. This allows the anchor system to be moved to a new location when desired.

As will be appreciated by those skilled in the art, with the anchoring system of the subject invention one can make use of the full length of the lanyard, thereby providing the worker with considerable freedom of movement. Moreover, the anchor assembly provides a good, safe means for anchoring the worker which can be readily fixed in position and released when desired. As should also be appreciated, since the strap is flexible it can be wrapped around a wide variety of surfaces and/or structures to which it will conform to provide the desired anchoring function.

Without further elaboration, the foregoing will so fully illustrate my invention that others may, be applying current or future knowledge, adopt the same for use under various conditions of service.

I claim:

1. An anchor system for use with a fall prevention device, said fall prevention device being arranged to be coupled to a worker at an elevated position to prevent said worker from falling and including flexible lanyard means, said anchor system being arranged to be releasably secured to a fixed member adjacent said elevated position and comprising:

first means for releasably holding a worker to a fixed member, said first means comprising an elongated strap formed of a strong and flexible material having first and second end portions; and second means for releasably fastening said elongated strap to said fixed member, said second means being fixedly secured to said first end portion of said strap and comprising:

means for receiving said second end portion of said strap so that said strap encircles said fixed member; and releasable locking means enabling said encircling strap to be pulled tightly around said fixed member into good frictional engagement therewith and to hold said strap in said position against accidental release therefrom, wherein said releasable locking means comprising a ratchet assembly; and third means for connecting the system to said worker, said third means being arranged for mounting on said encircling portion of said strap at any desired position thereon and having a connector arranged to be releasably connected to said flexible lanyard means.

2. The anchor system of claim 1 wherein said third means comprises a sleeve through which said strap extends, said sleeve being freely slideable along said strap.

3. The anchor system of claim 2 wherein said connector is fixedly secured onto said sleeve.

4. An anchor system for use with a fall prevention device, said fall prevention device being arranged to be coupled to a worker at an elevated position to prevent said worker from falling and including flexible lanyard means, said anchor system being arranged to be releasably secured to a fixed member adjacent said elevated position and comprising:

first means for releasably holding a worker to a fixed member, said first means comprising an elongated strap formed of a strong and flexible material having first and second end portions; and second means for releasably fastening said elongated strap to said fixed member, said second means being fixedly secured to said first end portion of said strap and comprising:

means for receiving said second end portion of said strap so that said strap encircles said fixed member; and releasable locking means enabling said encircling strap to be tensioned around said fixed member into good frictional engagement therewith and to hold said strap in said position against accidental release therefrom; and third means for connecting the system to said worker, said third means comprising a sleeve-like member mounted on said encircling portion of said strap secured thereto at any desired position, said sleeve-like member having a connector secured thereto arranged to be releasably connected to said flexible lanyard means.

5. The anchor system of claim 4 wherein said releasable locking means comprises a ratchet assembly.

* * * * *